US008297989B1

(12) United States Patent
Tang et al.

(10) Patent No.: US 8,297,989 B1
(45) Date of Patent: Oct. 30, 2012

(54) MOTHERBOARD WITH POWER CONNECTORS

(75) Inventors: Xian-Xiu Tang, Shenzhen (CN); Zhen-Xing Ye, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/253,991

(22) Filed: Oct. 6, 2011

(30) Foreign Application Priority Data

Aug. 25, 2011 (CN) ..... 2011 1 0246228

(51) Int. Cl.
*H01R 13/44* (2006.01)

(52) U.S. Cl. ..... 439/136

(58) Field of Classification Search ..... 439/718, 439/367, 131–140, 65, 67
See application file for complete search history.

(56) References Cited

U.S. PATENT DOCUMENTS

| | | | | | |
|---|---|---|---|---|---|
| 4,250,349 | A * | 2/1981 | Bennett | 439/142 |
| 4,415,044 | A * | 11/1983 | Davis | 439/142 |
| 4,660,912 | A * | 4/1987 | Tomek | 439/144 |
| 5,026,295 | A * | 6/1991 | Fong et al. | 439/135 |
| 5,242,311 | A * | 9/1993 | Seong | 439/135 |
| 5,361,492 | A * | 11/1994 | Miyazawa | 439/135 |
| 5,439,400 | A * | 8/1995 | Kozel et al. | 439/885 |
| 5,601,444 | A * | 2/1997 | Cox | 439/299 |
| 5,756,937 | A * | 5/1998 | Gleadall | 439/135 |
| 6,649,838 | B1 * | 11/2003 | Lopez et al. | 439/135 |
| 7,273,383 | B1 * | 9/2007 | Bennett | 439/142 |
| 7,946,865 | B1 * | 5/2011 | Lai | 439/135 |
| 2010/0279522 | A1 * | 11/2010 | Chen | 439/136 |

* cited by examiner

*Primary Examiner* — Briggitte R Hammond
(74) *Attorney, Agent, or Firm* — Altis Law Group, Inc.

(57) ABSTRACT

A motherboard includes a printed circuit board and a number of power connectors mounted on the printed circuit board. Each of the power connectors includes a connector body, a cover, and a connecting arm connecting the cover to the connector body. The connecting arm includes a first connecting portion extending from the connector body, and a second connecting portion extending from the cover and rotatably connected to the first connecting portion. The connector body includes a number of pins. The cover defines a number of retaining slots correspondingly to retain the pins of the connector body.

4 Claims, 2 Drawing Sheets

MOTHERBOARD WITH POWER CONNECTORS

BACKGROUND

Technical Field

The present disclosure relates to motherboards, and particularly to a motherboard equipped with a number of power connectors.

A motherboard of a computer is equipped with a number of power connectors, through which various electronic devices, such as a speaker, a universal serial bus device, and a fan, mounted in the computer are powered. Usually, due to a variety of the configurations of the computer, one or more of the power connectors will be unused. For example, if a computer includes a system fan but does not include a disk drive fan, the power connector for the disk drive fan will be unused. However, in mounting the system fan, the system fan may be coupled to the power connector for the disk drive fan by mistake.

BRIEF DESCRIPTION OF THE DRAWINGS

Many aspects of the present embodiments can be better understood with reference to the following drawings. The components in the drawing are not necessarily drawn to scale, the emphasis instead being placed upon clearly illustrating the principles of the present embodiments.

DETAILED DESCRIPTION

The disclosure, including the accompanying drawings, is illustrated by way of examples and not by way of limitation. It should be noted that references to "an" or "one" embodiments in this disclosure are not necessarily to the same embodiment, and such references mean at least one.

Figure 1:
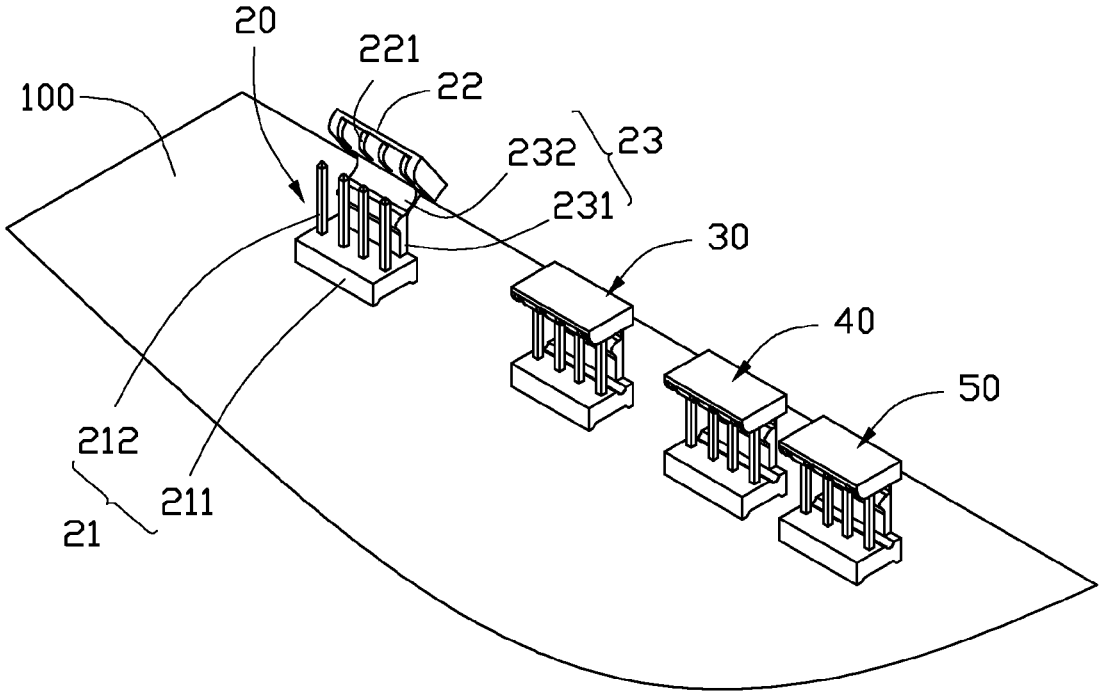
FIG. 1 is an isometric view of an embodiment of a motherboard, which includes a plurality of power connectors.

Referring to the FIG. 1, an embodiment of a motherboard includes a printed circuit board 100 and a plurality of power connectors 20, 30, 40, and 50 mounted to the printed circuit board 100, through which various electronic components are correspondingly powered.

The power connector 20 includes a connector body 21, a cover 22, and a connecting arm 23. The connector body 21 includes a base 211 disposed on the printed circuit board 100, and a plurality of pins 212 extending up from a top of the base 211. The cover 22 is made of rubber, plastics, or other elastic material. The cover 22 is substantially a parallelepiped with a plurality of retaining slots 221 defined in a bottom of the cover 22 and sized to snugly receive ends of the pins 212. The connecting arm 23 includes a first connecting portion 231 extending from the top of the base 211, and a second connecting portion 232 extending from the bottom of the cover 22 and rotatably connected to the first connecting portion 231. In one embodiment, the first and second connecting portions 231 and 232 are integrally formed with each other. In another embodiment, the first and second connecting portions 231 and 232 may be detachably connected to each other by a pivot shaft. The cover 22 can be swiveled into position to hold tops of the pins 212 in the retaining slots 221.

The power connectors 30, 40, and 50 are similar to the power connector 20, as described above.

Figure 2:
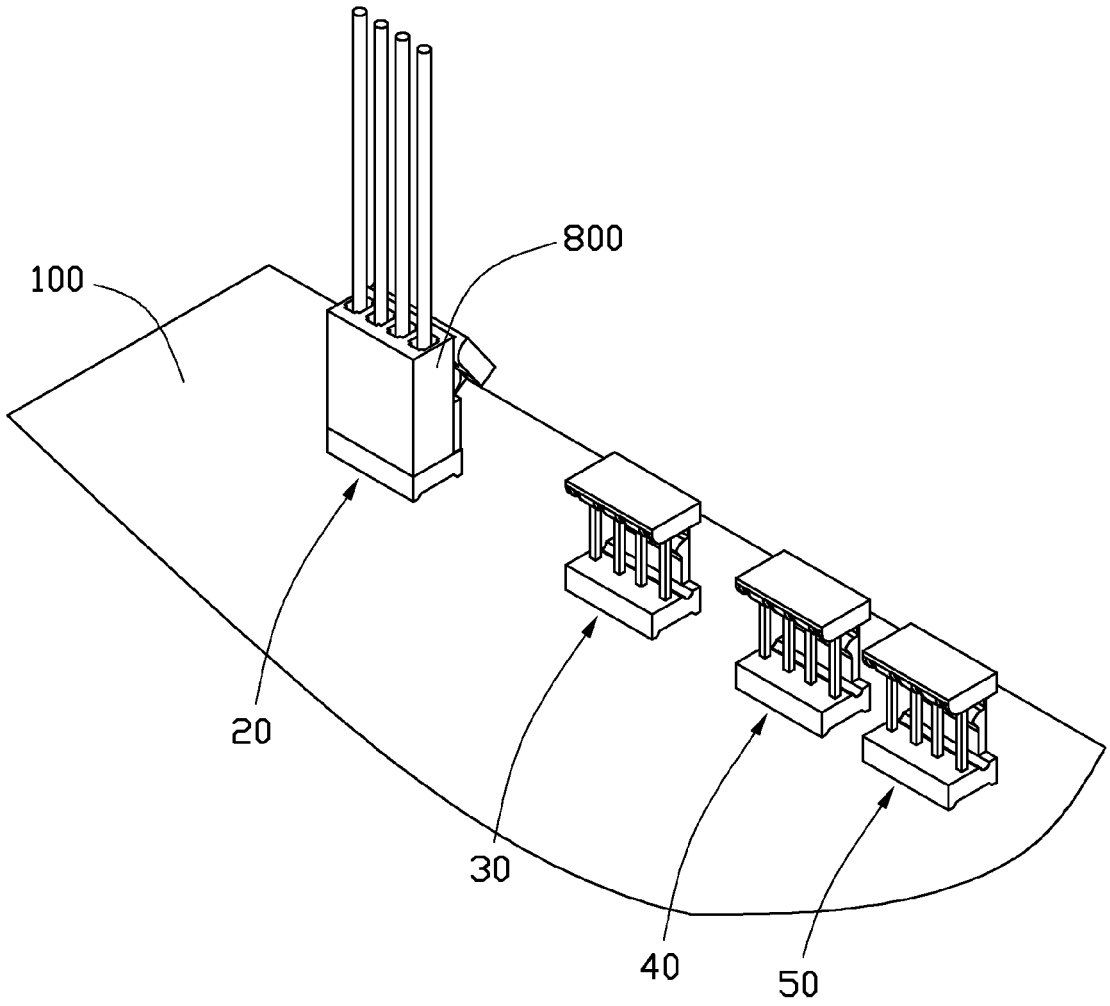
FIG. 2 an isometric view of an electronic device coupled to one of the power connectors of the motherboard of FIG. 1.

Referring to FIG. 2, when the power connector 20 is to be coupled to an electronic device 800, and the power connectors 30, 40, and 50 should remain unused, the covers 22 of the power connectors 30, 40, and 50 are all swiveled to hold the tops of the pins 212 of the corresponding powers connector 30, 40, and 50. Therefore, the electronic device 800 is prevented from being coupled to the power connectors 30, 40, and 50 by mistake.

It is to be understood, however, that even though numerous characteristics and advantages of the embodiments have been set forth in the foregoing description, together with details of the structure and function of the embodiments, the present disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A motherboard comprising:

a printed circuit board; and a plurality of power connectors mounted to the printed circuit board, each of the power connectors comprising:

a connector body comprising a base disposed on the printed circuit board, and a plurality of pins extending from the base;

a cover defining a plurality retaining slots to receive tops of the corresponding pins opposite to the base; and a connecting arm comprising a first connecting portion extending from the base, and a second connecting portion extending from the cover and rotatably connected to the first connecting portion.

2. The motherboard of claim 1, wherein the cover is made of elastic material to prevent the pins of the connector body from accidently disengaging from the retaining slots of the cover.

3. The motherboard of claim 2, wherein the cover is made of rubber or plastics.

4. The motherboard of claim 1, wherein the first and second connecting portions of the connecting arm are integrally formed with each other.

* * * * *